US008695174B1

(12) United States Patent
Cheng

(10) Patent No.: US 8,695,174 B1
(45) Date of Patent: Apr. 15, 2014

(54) ANCHOR APPARATUS FOR BEAD CHAIN OF WINDOW COVERING

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 0 days.

(21) Appl. No.: 13/775,598

(22) Filed: Feb. 25, 2013

(51) Int. Cl.
*E06B 9/00* (2006.01)
*E06B 9/326* (2006.01)

(52) U.S. Cl.
USPC ..... 24/116 A; 160/321; 160/178.1 R

(58) Field of Classification Search
USPC ..... 24/116 A, 115 R, 116 R, 130, 131 C; 174/138 B; 160/332, 173 R, 177 V, 228, 160/168.1 R, 168.1 V, 173 V, 178.1 V, 160/178.1 R, 84.04, 321, 24, 344, 178.2; 248/222.14; 474/136, 171; 254/391, 254/392
See application file for complete search history.

(56) References Cited

U.S. PATENT DOCUMENTS 3,168,768 A * 2/1965 Bohlinger et al. ..... 24/116 A
3,589,052 A * 6/1971 King ..... 43/44.88
6,085,824 A * 7/2000 Cadorette ..... 160/177 V
7,841,376 B2 * 11/2010 Lin ..... 160/178.1 R
8,333,357 B2 * 12/2012 Laughlin ..... 248/328
8,376,022 B2 * 2/2013 Lin ..... 160/321
8,499,814 B2 * 8/2013 Ng ..... 160/173 R
8,567,474 B2 * 10/2013 Lin ..... 160/178.1 R
2010/0219311 A1 * 9/2010 Ng ..... 248/222.14

* cited by examiner

*Primary Examiner* — Robert J Sandy
*Assistant Examiner* — Rowland D Do
(74) *Attorney, Agent, or Firm* — Muncy, Geissler, Olds & Lowe, P.C.

(57) ABSTRACT

An anchor apparatus for a bead chain of window covering comprises a first anchor member, a second anchor member, an anchor plate and a main fastener. The first anchor member has a first space to hold the second anchor member. The anchor plate is held in a lower side of the first space and a second space of the second anchor member to form a coupling relationship with the main fastener. The main fastener runs through the lower sides of the first and second anchor members and the anchor plate for closing while the upper sides of the first and second anchor members are opened, thereby allow the bead chain to be moved. The main fastener can be released to allow the anchor plate to push the second anchor member to move with the upper sides of the first and second anchor members closed to fix the bead chain.

8 Claims, 6 Drawing Sheets

ANCHOR APPARATUS FOR BEAD CHAIN OF WINDOW COVERING

FIELD OF THE INVENTION

The present invention relates to an anchor apparatus for a bead chain for window covering and particularly to a safe anchor apparatus for a bead chain for window covering.

BACKGROUND OF THE INVENTION

In many houses, bead chains are generally used to control movement of window shades to block sunshine, take sunshine or protect privacy. However, the bead chains usually are not fixed securely, when wind blows into the houses, the bead chains can easily sway to hit walls and generate noises, or the bead chains often are played by children at homes to result in damage of the bead chains and the tracks of window coverings, or even cause the children hurt or strangling. Hence if the bead chain is not properly fixed via a desired anchor apparatus, it will greatly threaten human safety.

SUMMARY OF THE INVENTION

The primary object of the present invention is to provide an anchor apparatus for a bead chain of window covering to improve safety.

To achieve the foregoing object, the anchor apparatus of the invention comprises a first anchor member, a second anchor member, an anchor plate and a main fastener. The first anchor member has a first boss at a lower side of one side thereof, a first front side and a first rear side at two lateral sides of the one side opposite to each other, a first space formed between the first front side and first rear side, two first recesses at an upper side thereof, and a wedge element extended above the first recesses. The second anchor member is held in the first space and hinged on the first anchor member, and includes a second boss at a lower side of one side thereof leaning on the first boss in a closed state, a second space at the lower side of the one side thereof, two second recesses at an upper side corresponding to the two first recesses, and a wedge slot above the second recesses to be wedged by the wedge element. The anchor plate is held in the lower side of the first space and the second space, and has one end leaning on the first boss and another end leaning on the second boss. The main fastener is inserted into the second anchor member, anchor plate and first anchor member to control coupling or separation of the first anchor member and the second anchor member. Depending on whether the upper sides of the first anchor member and second anchor member are opened or closed, the bead chain of the window covering is allowed to move or fix.

The anchor apparatus of the invention thus formed can easily fix the bead chain of the window covering to improve safety when in use.

The foregoing, as well as additional objects, features and advantages of the invention will be more readily apparent from the following detailed description, which proceeds with reference to the accompanying drawings. The drawings serve merely for illustrative purpose and are not the limitation of the invention.

DETAILED DESCRIPTION OF THE PREFERRED EMBODIMENTS

Figure 1:
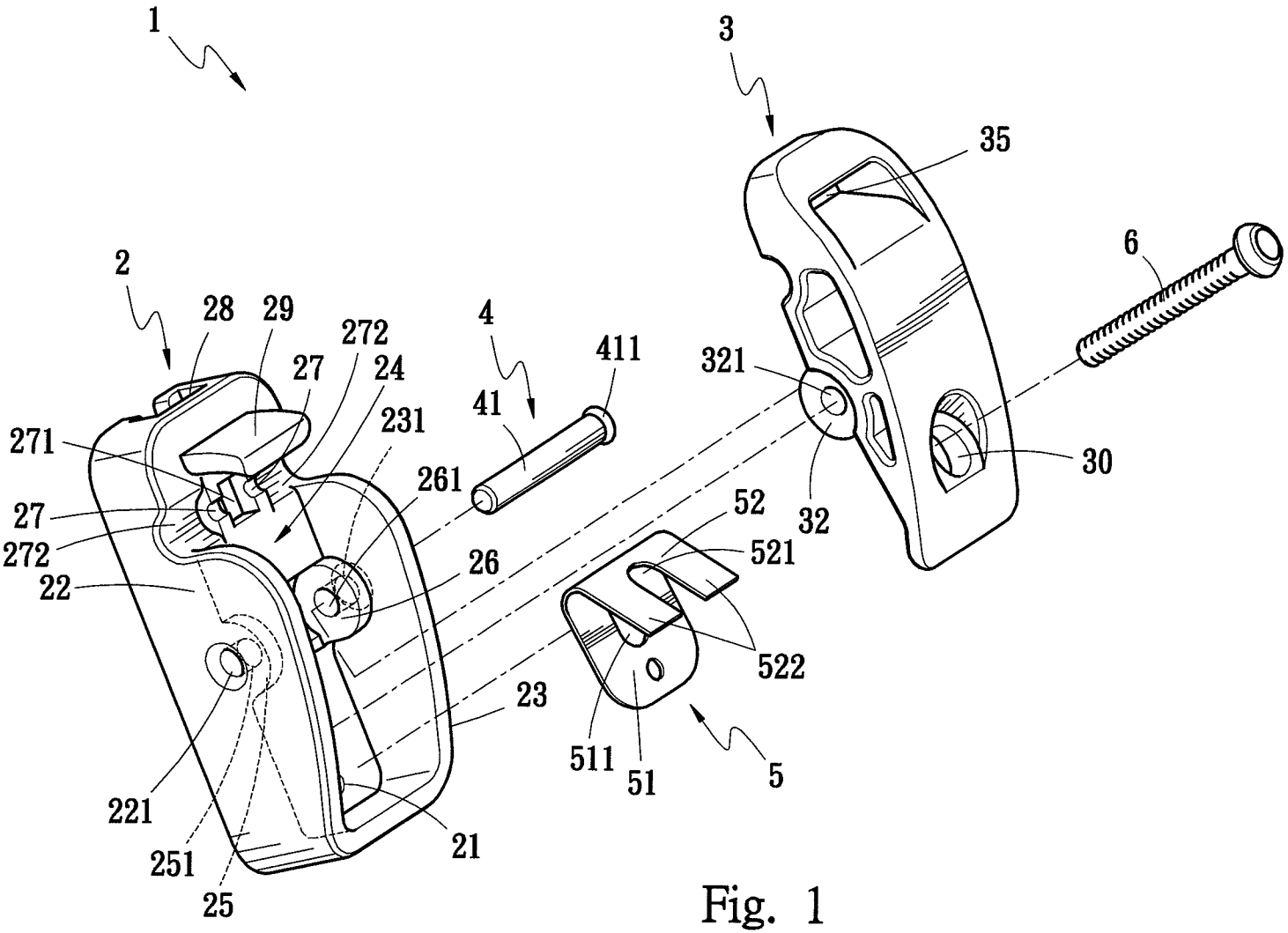
FIG. 1 is an exploded view of the invention.

Please refer to FIG. 1, the present invention aims to provide an anchor apparatus 1 for a bead chain of window covering that comprises a first anchor member 2, a second anchor member 3, a secondary fastener 4, an anchor plate 5 and a main fastener 6.

Please also refer to FIGS. 1 through 4 for details of the invention. The first anchor member 2 has a first holding bore 20 at one side, a first boss 21 extended below the first holding bore 20, a first front side 22 and a first rear side 23 at two lateral sides of the one side opposite to each other, and a first space 24 formed between the first front side 22 and first rear side 23. The first front side 22 and first rear side 23 have respectively a first front anchor portion 25 and a first rear anchor portion 26 located in the first space 24, and a burying hole 221 and 231 corresponding to each other and leading to the first space 24. The first front anchor portion 25 and first rear anchor portion 26 have respectively an aperture 251 and 261 corresponding to the burying holes 221 and 231. The first anchor member 2 further has two first recesses 27 at an upper side corresponding to each other. The first recesses 27 are threaded through by a chain rope 81 of a bead chain 8. The first recesses 27 are interposed by a first slot 271 and respectively bordered by a second slot 272 at one side threaded through by beads 82 of the bead chain 8. The first anchor member 2 also has an arched wedge element 29 extended above the first recesses 27.

The second anchor member 3 is held in the first space 24 and hinged on the first anchor member 2, and includes a second holding bore 30 corresponding to the first holding bore 20, a second boss 31 at a lower side of the one side for leaning on the first boss 21 in a closed state, an anchor portion 32 at the one side, and a second space 33 below the anchor portion 32. The anchor portion 32 has a through hole 321 corresponding to the apertures 251 and 261 of the first front anchor portion 25 and the first rear anchor portion 26. The anchor portion 32 has two indented rims 322 at two sides leaned respectively by the first front anchor portion 25 and first rear anchor portion 26. Above the anchor portion 32, there are two second recesses 34 corresponding to the first recesses 27 and being threaded through by the chain rope 81 of the bead chain 8. The two second recesses 34 are interposed by a third slot 341 corresponding to the first slot 271, and respectively bordered by a fourth slot 342 at one side corresponding to the second slot 272 and being threaded through by the beads 82 of the bead chain 8. Above the second recesses 34, there is a concave-shaped wedge slot 35 wedged by the wedge element 29.

Please refer to FIGS. 1 through 4, the anchor plate 5 is elastic and held in the lower side of the first space 24 and in the second space 33, and has a longer end 51 with a first hole 511 corresponding to the first holding bore 20 and a shorter end 52 with a second hole 521 corresponding to the second holding bore 30 and two legs 522. The longer end 51 leans on an upper side of the first boss 21, and the two legs 522 of the shorter end 52 lean on an upper side of the second boss 31; meanwhile, the first front anchor portion 25 and first rear anchor portion 26 lean on the indented rims 322 at two sides of the anchor portion 32 to make the second anchor member 32 be held in the first space 24. Then, the first recesses 27 and second recesses 34 are closed to hold the chain rope 81 of the bead chain 8, and the beads 82 also are held in the first slot 271 and second slot 341.

The secondary fastener 4 is an insertion pin 41, and in this embodiment, has a first holding flange 411 at one end. The secondary fastener 4 runs through the burying hole 231 of the first rear side 23, aperture 261 of the first rear anchor portion 26, through hole 321 of the anchor portion 32, another aperture 251 of the first front anchor portion 25 and another burying hole 221 of the first front side 22 for coupling securely. Thus the first anchor member 2, second anchor member 3 and anchor plate 5 can be coupled together to allow the first anchor member 2 and second anchor member 3 to open or close through a lever principle.

Figure 3:
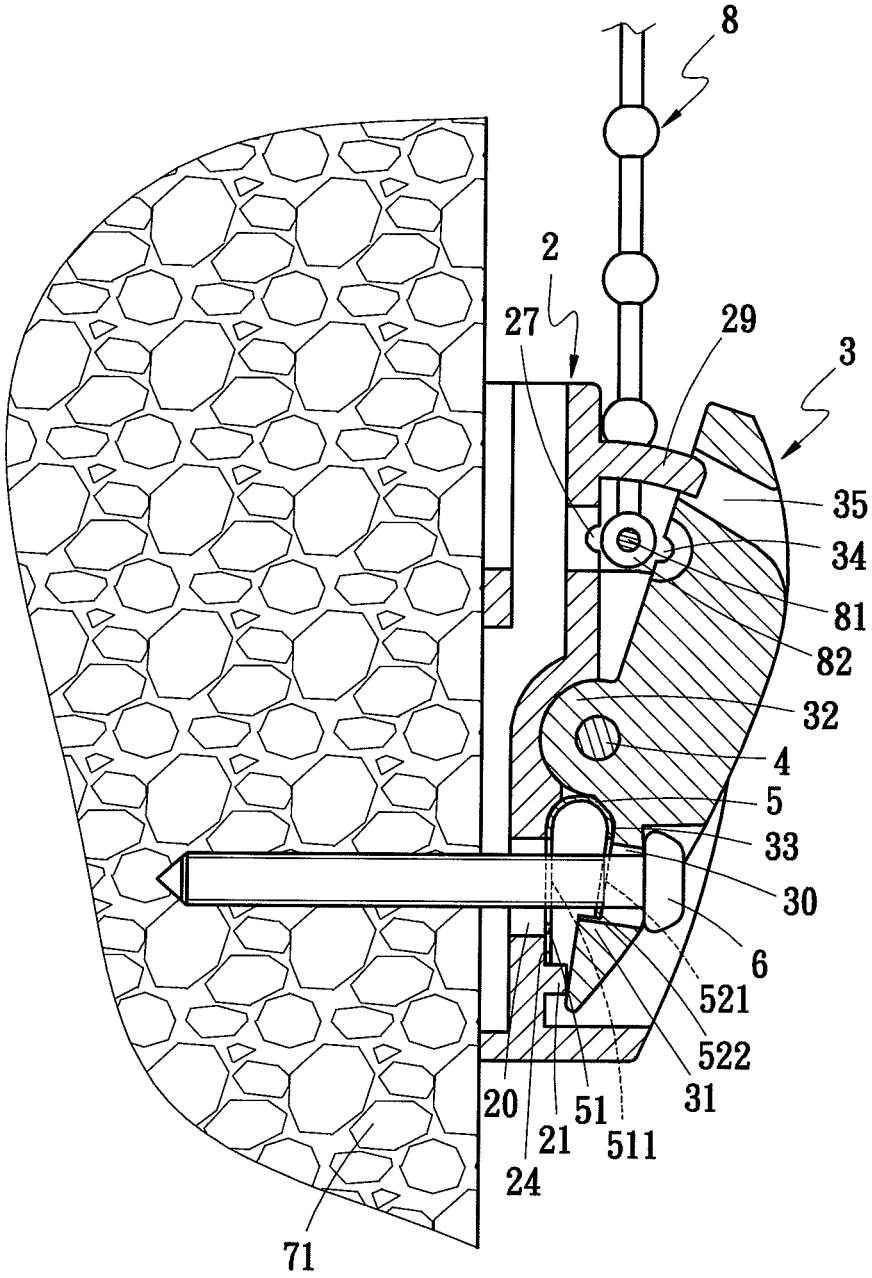
FIG. 3 is a sectional view of the invention in an assembly condition.
Figure 4:
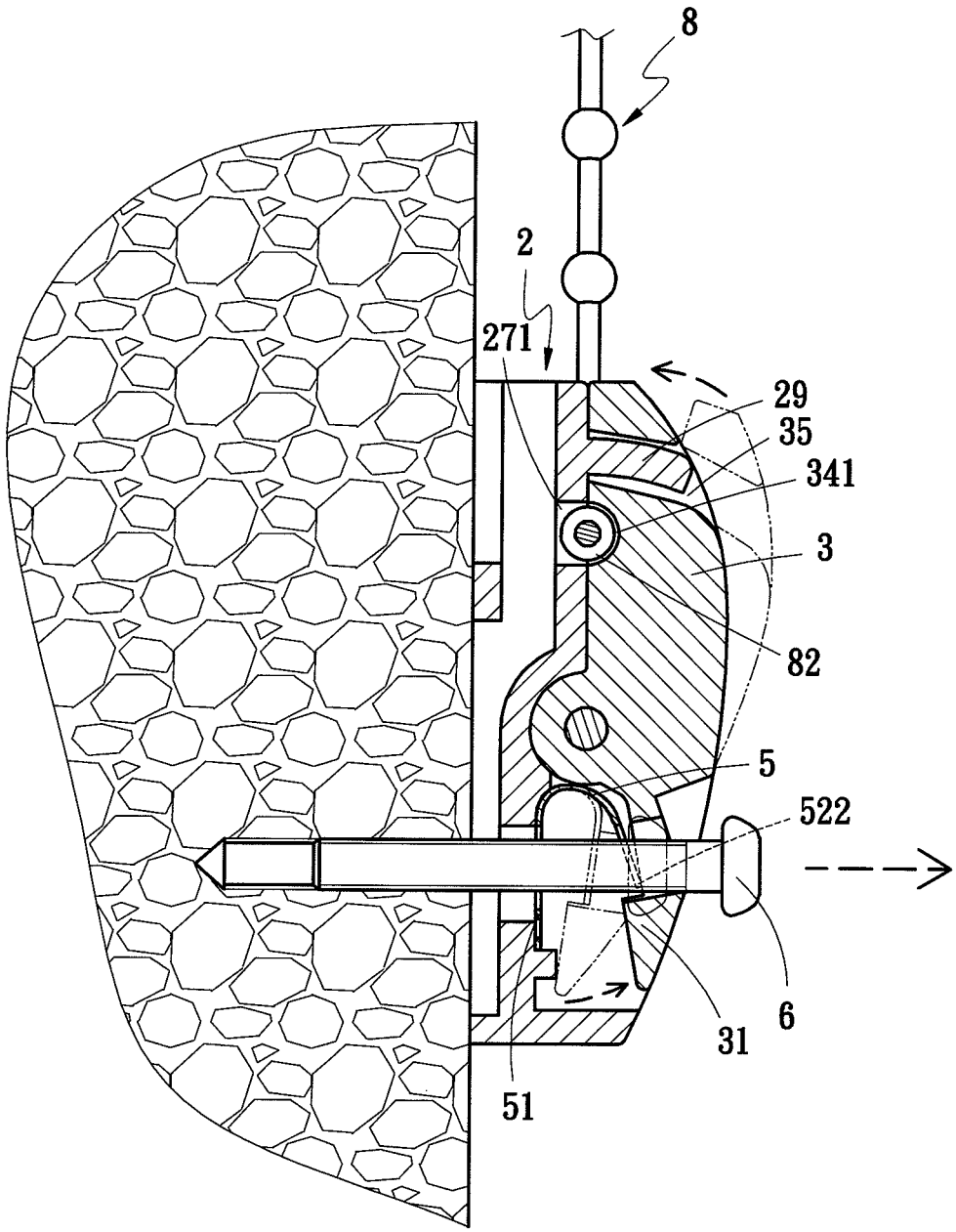
FIG. 4 is a sectional view of the invention in a use condition.
Figure 5:
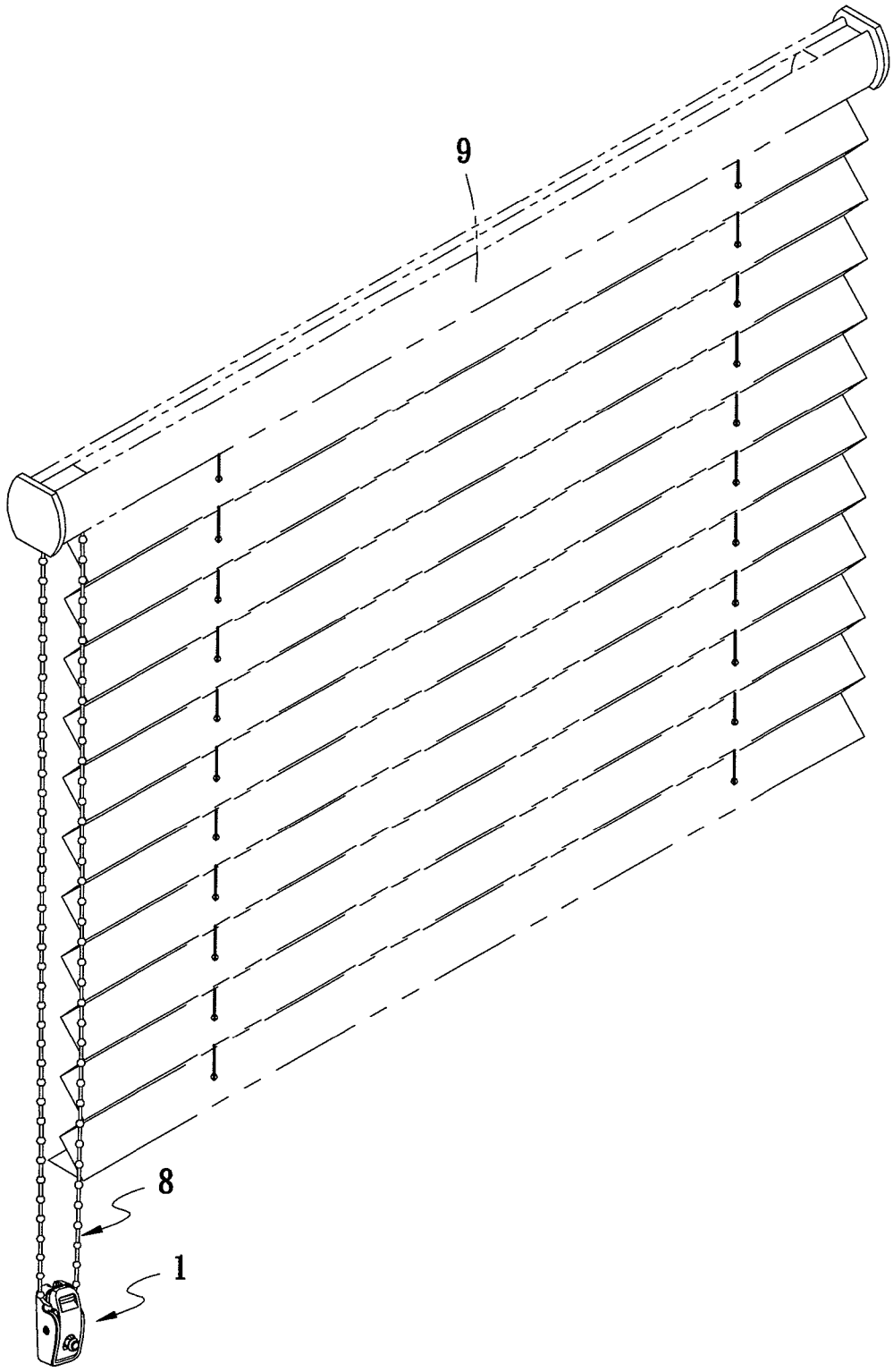
FIG. 5 is a schematic view of the invention in a use condition.

Please refer to FIG. 3 for the invention with the bead chain 8 not yet being fixed. The main fastener 6 such as a screw runs through the second holding bore 30, second hole 521, first hole 511 and first holding bore 20 and penetrates into a wall 71 for positioning. Meanwhile, the upper sides of the first anchor member 2 and second anchor member 3 are opened, so that the window covering 9 can be adjusted for extending or retracting (referring to FIG. 5). If fixing the bead chain 8 is desired to prevent from sliding and causing danger, referring to FIG. 4 by the arrow directions, the main fastener 6 is released to make the legs 522 of the anchor plate 5 push the second boss 31 outwards; meanwhile, the wedge slot 35 at the upper side of the second anchor member 3 is moved and wedged by the wedge element 29 for coupling, and the beads 82 of the bead chain 8 are held in the first slot 271 and second slot 341 without moving.

Figure 2:
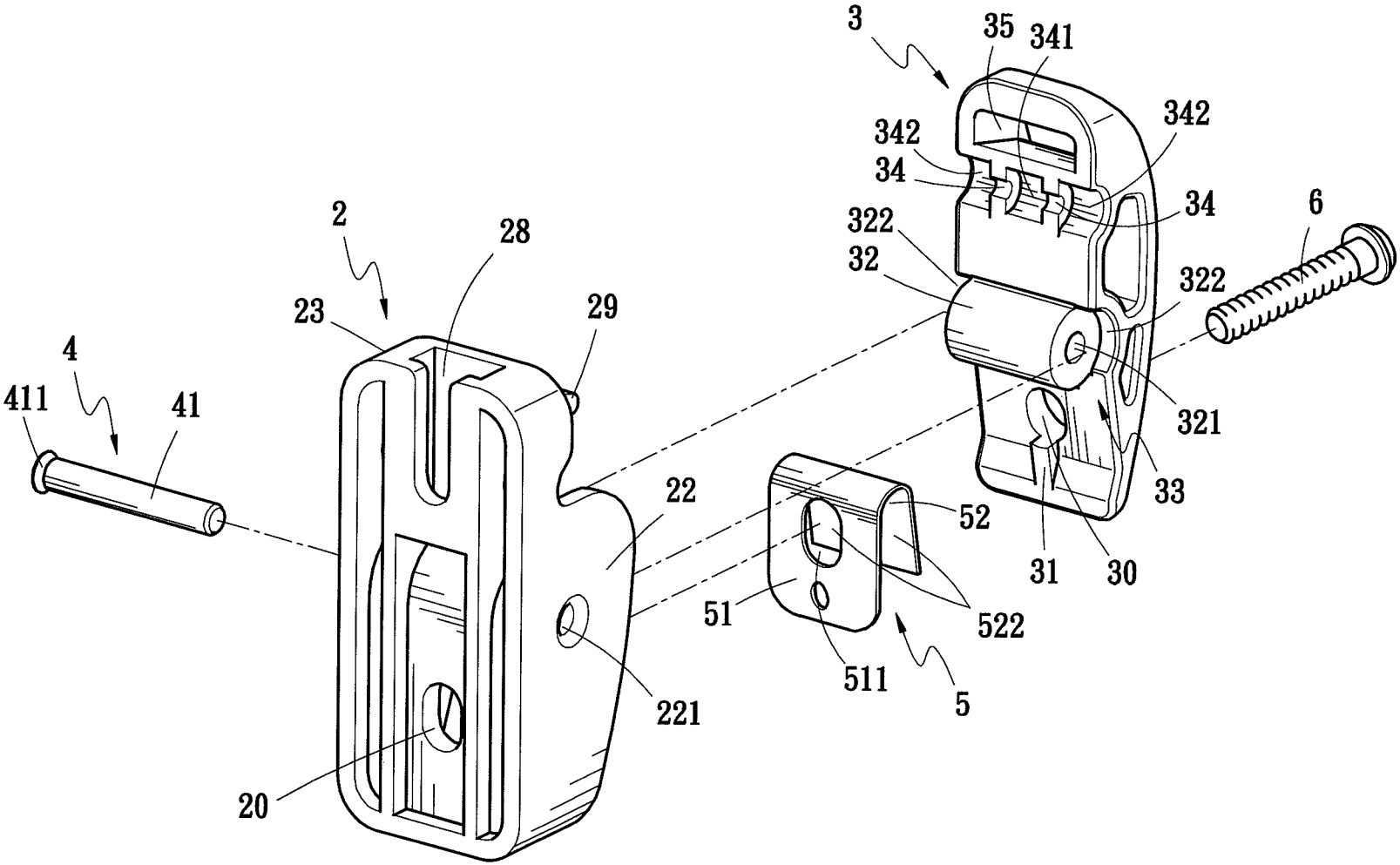
FIG. 2 is another exploded view of the invention.
Figure 6:
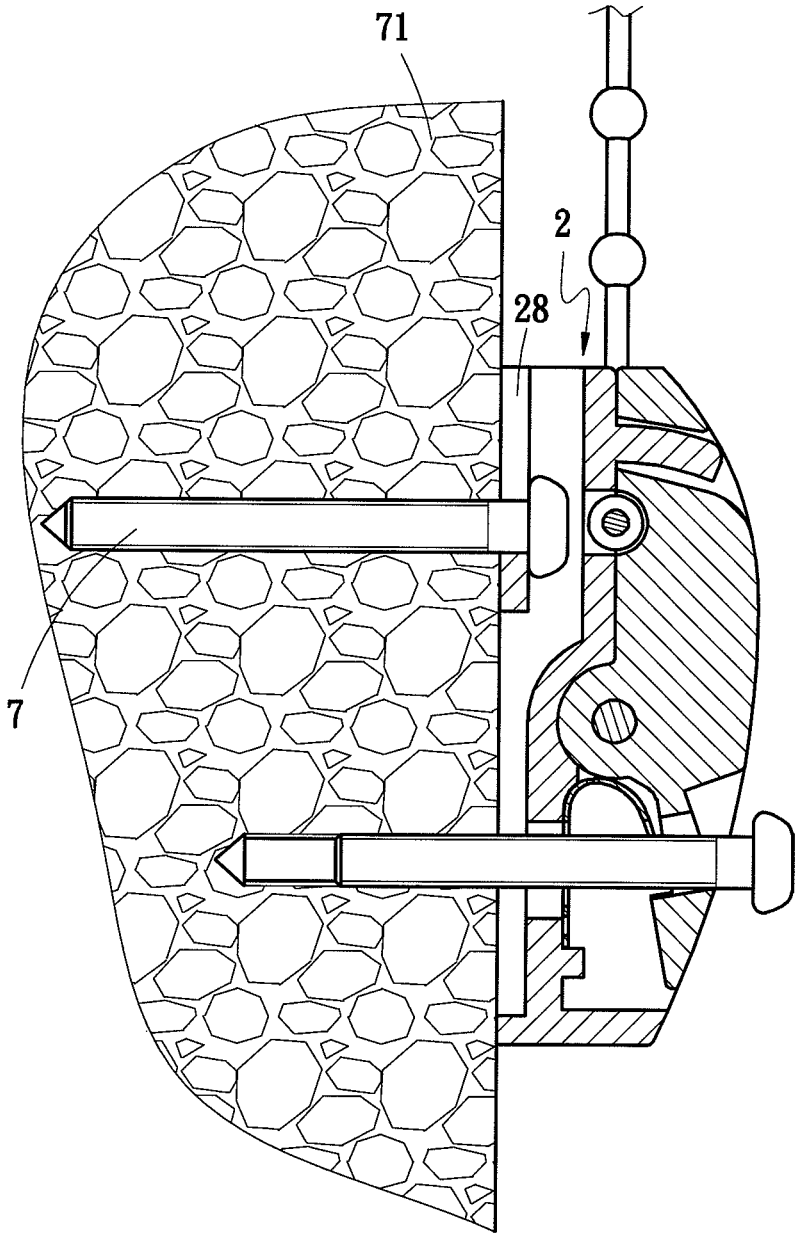
FIG. 6 is a sectional view of another embodiment of the invention.

Referring to FIG. 6, the first anchor member 2 further has a holding trough 28 at the upper side of another side thereof (also referring to FIGS. 1 and 2). A second fastener 7 is provided with one end fixed in the wall 71 and another end sliding into the holding trough 28 from the upper side of the first anchor member 2, thus the anchor apparatus 1 of the invention can be securely mounted. Through the aforesaid structure, the anchor apparatus 1 of the invention can be operated easily and meet safety requirements.

What is claimed is:

1. An anchor apparatus for a bead chain of window covering, comprising:

a first anchor member which includes a first boss at a lower side of one side thereof, a first front side and a first rear side at two opposite lateral sides of the one side to form a first space therebetween, two first recesses at an upper side, and a wedge element extended above the two first recesses;

a second anchor member which is held in the first space and hinged on the first anchor member, and includes a second boss at a lower side of one side thereof leaning on the first boss in a closed state, a second space at the lower side of the one side, two second recesses at an upper side corresponding to the two first recesses, and a wedge slot above the two second recesses to be wedged by the wedge element;

an anchor plate which is held in a lower side of the first space and the second space, and includes one end leaning on the first boss and another end leaning on the second boss; and a main fastener which runs through the lower side of the second anchor member, the anchor plate and the lower side of the first anchor member to control coupling or separation of the first anchor member and the second anchor member such that a bead chain of a window covering is moved or fixed.

2. The anchor apparatus of claim 1, wherein the first front side includes a first front anchor portion in the first space and the first rear side includes a first rear anchor portion in the first space; the second anchor member including an anchor portion at one side above the second space, the anchor portion including two indented rims at two sides thereof leaned respectively by the first front anchor portion and the first rear anchor portion; the first rear side, the first rear anchor portion, the anchor portion, the first front anchor portion and the first front side being run through by a secondary fastener for positioning.

3. The anchor apparatus of claim 2, wherein the secondary fastener is an insertion pin, the first front side and the first rear side including respectively a burying hole, the first front anchor portion and the first rear anchor portion including respectively an aperture corresponding to the burying hole, the anchor portion including a through hole corresponding to the apertures of the first front anchor portion and the first rear anchor portion that are run through by the secondary fastener for positioning.

4. The anchor apparatus of claim 1, wherein the main fastener is a screw, the first anchor member including a first holding bore at the lower side of the one side thereof, the second anchor member including a second holding bore at the lower side of the one side thereof corresponding to the first holding bore, the anchor plate being elastic and including a longer end with a first hole corresponding to the first holding bore and a shorter end with two legs and a second hole corresponding to the second holding bore, the main fastener running through the second holding bore, the second hole and the first hole of the anchor plate and the first holding bore to control coupling or separation of the first anchor member and the second anchor member.

5. The anchor apparatus of claim 1, wherein the wedge element is formed in an arched shape and the wedge slot is formed in a concave arched shape wedged by the wedge element.

6. The anchor apparatus of claim 1, wherein the two first recesses are interposed by a first slot and respectively bordered by a second slot at one side thereof, and the two second recesses are interposed by a third slot corresponding to the first slot and respectively bordered by a fourth slot at one side thereof corresponding to the second slot that are threaded through by the bead chain.

7. The anchor apparatus of claim 1, wherein the first anchor member further includes a holding trough at the upper side of another side to hold a second fastener.

8. The anchor apparatus of claim 7, wherein the second fastener is a screw.

* * * * *